US005526638A

United States Patent [19]

Bock et al.

[11] Patent Number: 5,526,638

[45] Date of Patent: Jun. 18, 1996

[54] OPEN-END SPINNING ROTOR HAVING AN IMPROVED CONNECTION DEVICE FOR THE SPINNING ROTOR AND ROTOR SHAFT

[75] Inventors: Erich Bock, Wettstetten; Edmund Schuller, Ingolstadt; Josef Schermer, Bergheim-Unterstall; Klaus Schoberth, Ingolstadt, all of Germany

[73] Assignee: Rieter Ingolstadt Spinnereimaschinenbau AG, Ingolstadt, Germany

[21] Appl. No.: 225,841

[22] Filed: Apr. 11, 1994

[30] Foreign Application Priority Data

Apr. 16, 1993 [DE] Germany ..... 43 12 365.1

[51] Int. Cl.[6] ..... D01H 4/00

[52] U.S. Cl. ..... 57/404; 57/406

[58] Field of Search ..... 57/400, 404, 406, 57/414, 416; 403/267, 261

[56] References Cited

U.S. PATENT DOCUMENTS

| | | | |
|---|---|---|---|
| 1,659,573 | 11/1927 | Searles | 403/261 |
| 3,331,258 | 7/1967 | Eckerle et al. . | |
| 3,367,687 | 2/1968 | Jenkins | 403/261 |
| 3,822,541 | 7/1974 | Croasdale et al. | 57/416 |
| 3,845,612 | 11/1974 | Chisholm et al. | 57/416 |
| 3,875,732 | 1/1975 | Ellingham | 57/406 |
| 4,170,102 | 10/1979 | Whiteley . | |
| 4,319,449 | 3/1982 | Hofmann . | |
| 4,339,911 | 7/1982 | Hofmann . | |
| 4,351,407 | 9/1982 | Call . | |
| 4,358,922 | 11/1982 | Feldstein | 57/414 |
| 4,358,923 | 11/1982 | Feldstein | 57/414 |
| 4,432,662 | 2/1984 | Ronnkvist . | |
| 4,492,077 | 1/1985 | Raasch et al. | 57/414 |
| 4,503,663 | 3/1985 | Oexler | 57/404 |
| 4,594,020 | 6/1986 | Hughes . | |
| 4,641,546 | 2/1987 | Mettler . | |
| 4,712,369 | 12/1987 | Vernon . | |
| 4,713,932 | 12/1987 | Zott . | |
| 4,866,927 | 9/1989 | Fetzer et al. | 57/414 |
| 4,909,656 | 3/1990 | Lai . | |
| 5,175,992 | 1/1993 | Stahlecker | 57/406 |

FOREIGN PATENT DOCUMENTS

| | | | |
|---|---|---|---|
| 0090939 | 2/1983 | European Pat. Off. . | |
| 2504401 | 8/1976 | Germany . | |
| 2812297 | 9/1978 | Germany . | |
| 2939326C2 | 4/1981 | Germany . | |
| 3519536A1 | 4/1986 | Germany . | |
| 3815182 | 11/1989 | Germany | 57/414 |
| 3835037A1 | 4/1990 | Germany . | |
| 4020518A1 | 1/1992 | Germany . | |
| 1383194 | 2/1975 | United Kingdom . | |
| 1410109 | 10/1975 | United Kingdom . | |
| 2122226 | 1/1984 | United Kingdom . | |
| 2129840 | 5/1984 | United Kingdom . | |

*Primary Examiner*—William Stryjewski
*Attorney, Agent, or Firm*—Dority & Manning

[57] ABSTRACT

To attach spinning rotors to their rotor shaft, the rotor shaft is provided with a stop against which the collar for the seating of the spinning rotor bears. The stop can be made in one piece with the rotor shaft, and be in the form of a micro-stop against which the collar bears in an axial direction.

23 Claims, 3 Drawing Sheets

OPEN-END SPINNING ROTOR HAVING AN IMPROVED CONNECTION DEVICE FOR THE SPINNING ROTOR AND ROTOR SHAFT

BACKGROUND OF THE INVENTION

The present invention relates to an open-end spinning rotor. EP 0 090 939 A2discloses a method by which a collar is pressed on a shaft, is pressed against the spinning rotor, and is attached by means of a conical spring washer. DE-OS 28 12 297 discloses an open-end spinning rotor made in one piece with a hub and connected to the shaft through shrink-fitting of the hub on the shaft. DE-A 29 39 325 describes a rotor which is separably joined to a collar by means of hooks. DE-A 40 20 518 discloses a rotor shaft which is made in one piece with a collar, with the spinning rotor being attached to the shaft in that the latter bears upon the collar and is pressed by means of a conical spring washer against the collar.

Open-end spinning rotors are operated at rotational speeds exceeding 100,000 RPM. The most stringent specifications are required for the attachment of the spinning rotor since it is under great stress because of mechanical oscillations. At the same time, operation at such high rotational speed requires, because of the known technical problems of oscillation, that the axial projection of the spinning rotor to its nearest bearing point, i.e. a pair of bearing disks, should be as short as possible. This necessity requires that the axial length of the collar must be kept to a minimum, and this has the disadvantage with pressed-on collars that less surface is available, resulting in the danger that the connection between the power and shaft may open up during operation. If the rotor shaft and the collar are made in one piece this disadvantage can be avoided, but an open-end spinning rotor designed in this manner can only be manufactured at great cost. It is a further disadvantage that the shaft is not universally suited for utilization both with a thick-walled and a thin-walled spinning rotor, so that the collar must be ground to balance the spinning rotor. When a spinning rotor is being replaced, the hub cannot be replaced at the same time, and this has as a consequence that the newly installed spinning rotor, together with the shaft which is used again, is very difficult to balance again.

OBJECTS AND SUMMARY OF THE INVENTION

It is a principal object of the present invention to design an open-end spinning rotor in such a manner that the disadvantages of the state of the art are avoided, that a reliable attachment of the rotor is achieved even in operation at high rotational speeds, and in particular that a low-cost shaft with versatile application possibility can be produced and can be used for different rotors. Additional objects and advantages of the invention will be set forth in part in the following description, or may be obvious from the description, or may be learned through practice of the invention.

The objects are attained through the device of the present invention. By installing a stop on the rotor shaft, the rotor shaft is provided with axial support which supports the collar in particular during axial oscillations of the rotor, so that loosening or shifting of the collar on the rotor shaft is prevented. If the spinning rotor is made in one piece with the collar, the collar can be especially short in the axial direction, and this improves the oscillation attitude of the rotor in operation since the spinning rotor can be brought closer to the bearing point. The collar can be made shorter because of the stop. It is especially advantageous for the spinning rotor to be pressed axially against the collar because a thin-walled rotor can be attached in this manner, so that the axial distance to the rotor bearing can also be shortened. It is especially advantageous for the stop and the rotor shaft to be made in one piece. This makes it possible to machine the surface of the rotor shaft and to form the stop at the same time in one operation. In a further advantageous embodiment, the invention is made in the form of a groove which interacts with a snap ring. Especially good support for the collar is provided by a stop which is made in the form of a cylindrical or conical diameter change. A cylindrical diameter change provides a defined stop for the collar in the axial direction. A short axial length of the stop, e.g. measuring less than 15 mm in length, also contributes to the possibility of keeping the distance between the spinning rotor and the bearing point short.

It is especially advantages if the axial length of the stop measures between 0.1 and 3 mm. If the radial length of the stop is limited to double the rotor shaft diameter the least possible mass is attached to the rotor shaft, and this also improves running behavior at high rotational speeds. It is especially advantageous to make the stop in the form of a micro-stop, with the stop extending for less than 2 mm beyond the rotor shaft for example. It is especially advantageous for the stop to extend beyond the rotor shaft by a distance between 0.1 mm and 1 mm, e.g. 0.2 mm. This is especially advantageous in particular because such a stop can be worked out while machining a blank for the rotor shaft which, as is known, has an excessive radial dimension, without having to incur the cost of additional material. This makes it possible to grind the motor shaft to completion and to produce the stop in one single operation. This results in an especially low-cost method for the production of the rotor shaft, and this has also an advantageous effect on the cost of the spinning rotor. An advantageous embodiment of the invention consists in pressing the spinning rotor against the collar by means of a conical spring washer, with the rotor being attached by means of same. The conical spring washer produces a particularly good attachment of the rotor while the collar can be kept short. This has the consequence that the overhang of the rotor is also influenced favorably. By designing the rotor shaft or the collar with a centering piece it becomes possible for the spinning rotor itself to be installed by pressing it on, so that the stress of the collar is reduced and the latter can thereby be kept advantageously shorter. If the diameter of the centering piece is kept equal to the diameter of the rotor shaft, this simplifies the machining of the rotor shaft. Through the advantageous combination, e.g. of a thin-walled rotor with an axially longer collar and vice versa, it is possible to combine a thick-walled and a thin-walled rotor with one and the same shaft without changing the axial position of the rotor groove. Therefore the axial position of the spinning rotor, if the latter is used in a spin box, need not be adjusted again.

The invention in which the contact surface between the components pressed on the rotor shaft is provided with solid particles is especially advantageous. This has as a consequence that the frictional value between these surfaces is increased considerably. In this manner it is possible to shorten the axial length of the component installed on the rotor shaft without detriment to the strength of the connection. It is especially advantageous to coat at least one of the surfaces with a bonding layer into which the solid particles are embedded. They are preferably nickel particles. Diamonds are an especially well-suited material for the solid particles. But other hard particles, e.g. silicon carbide, can also be used for this. The invention id described below through drawings.

DETAILED DESCRIPTION OF THE PREFERRED EMBODIMENTS

Figure 1:
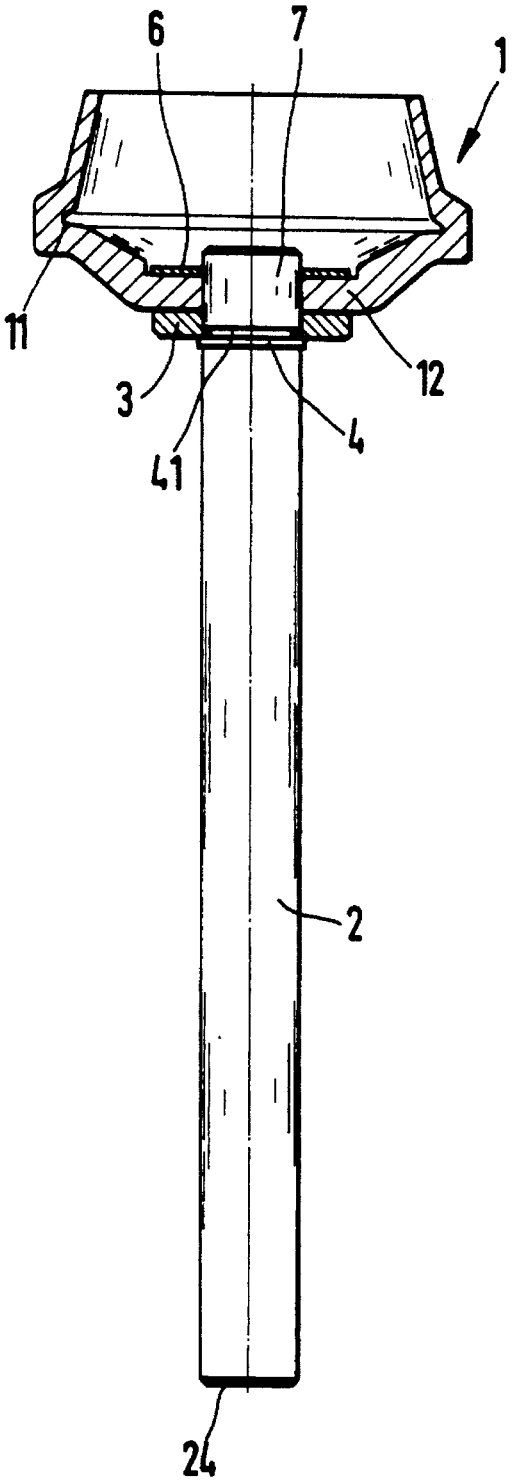
FIG. 1 shows a thick-walled spinning rotor designed according to the invention.

Reference will now be made in detail to the presently preferred embodiments of the invention, one or more examples of which are illustrated in the drawings. Each example is provided by way of explanation of the invention, not limitation of the invention. Also, the numbering of components is consistent throughout the application, with the same components having the same number in each of the drawings.

FIG. 1 shows a spinning rotor 1 made according to the invention which is attached by means of a collar 3 and a conical spring washer 6 to its rotor shaft 2. The shaft 2 is provided with a stop 4 upon which the collar 3 bears. The stop 4 is made in the form of a micro-stop which has an axial projecting end of 0.8 mm and extends radially by 0.2 mm over the centering piece 7 which has the same diameter as the rest of the rotor shaft 2. The radial projecting end of the stop 4 may be selected greater or smaller, but the above-mentioned dimension is especially advantageous. When the final contour is produced during manufacture of the rotor shaft by grinding down the blank, the stop 4 is advantageously created in that this area is not ground down. Depending on the diameter of the blank, it is absolutely possible also to achieve a radial projecting end of the stop between 0.1 mm and 0.2 mm.

The collar 3 is pressed on the centering piece 7, and advantageously also the spinning rotor 1, as this affords additional stability of the connection. It is however also possible for the collar and the rotor not to be pressed on, although this would finally require a greater radial projecting end of the stop. The spinning rotor 1 is pressed against the collar 3 by means of the conical spring washer 6 so that the connection between the spinning rotor 1 and the rotor shaft 2 is imparted its final strength. The spinning rotor 1 of FIG. 1 is a thick-walled spinning rotor since it is lathed from a full blank. The rotor bottom 12 has here a thickness of several millimeters.

Figure 2:
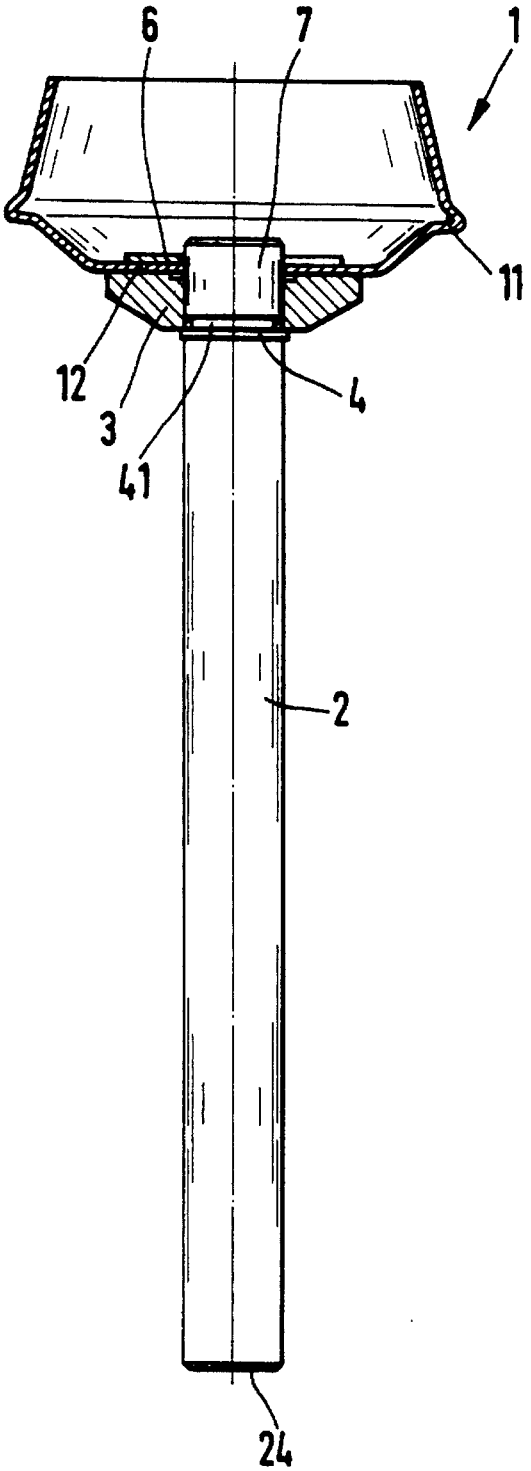
FIG. 2 shows a thin-walled spinning rotor according to the invention.

FIG. 2 shows a spinning rotor 1 which is attached on a rotor shaft 2. The spinning rotor 1 of FIG. 2 is a thin-walled spinning rotor, such as is produced e.g. by forming a sheet of steel. The rotor bottom 12 has a wall thickness of only approximately 1 mm. As with the spinning rotor of FIG. 1, the rotor of FIG. 2 bears upon the collar 3 and is pressed against it by means of a conical spring washer 6. The collar 3 in turn is pressed on the rotor shaft 2 and bears upon the stop 4. The axial length of the collar 3 with the spinning rotor of FIG. 2 is greater than that of the collar 3 of FIG. 1. In both rotors the distance from the plane in which the rotor groove 11 lies to the end 24 of the rotor shaft 2 is the same. This has the advantage that the thin-walled as well as the thick-walled rotor can be used in the same spinning station without requiring adjustment. Also, the spinning rotors of FIGS. 1 and 2 are attached to a rotor shaft 2 of identical design. Thanks to the invention, it is possible to attach different spinning rotors on one type of rotor shaft, with the requirement that the distance between rotor groove 11 and end 24 remains the same being furthermore met. The stop 4 according to the invention makes it possible to make the collar 3 very short axially so that the spinning rotor can be supported by bearings in close proximity of the spinning rotor 1. The micro-stop 4 ensures secure attachment of the spinning rotor 1 on the rotor shaft 2 in a simple manner in spite of the small axial length of the collar 3. The axial length of the collar 3 is coordinated with the thickness of the bottom 12 of the spinning rotor 1, and this ensures that the position of the rotor groove 11 remains the same with thin-walled as well as with thick-walled spinning rotors.

Figure 3:
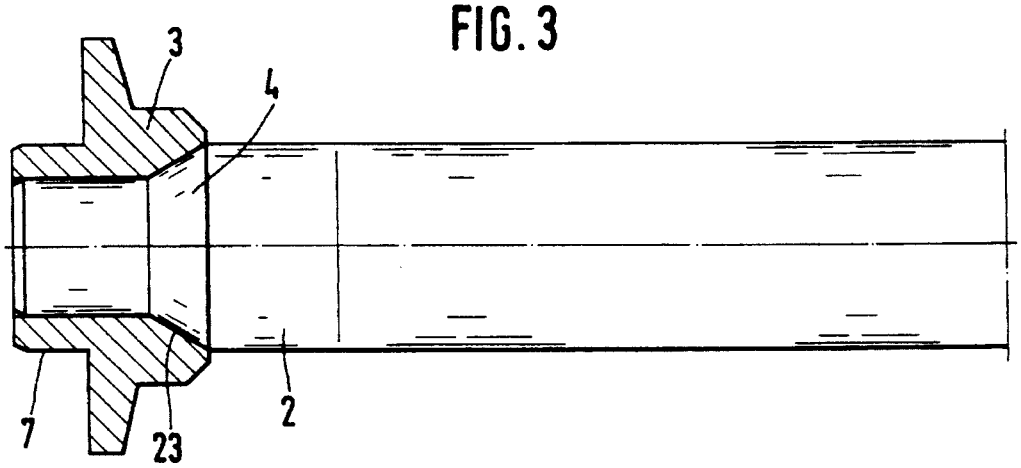
FIG. 3 shows a shaft for an open-end spinning rotor with conical diameter change of the rotor shaft.
Figure 4:
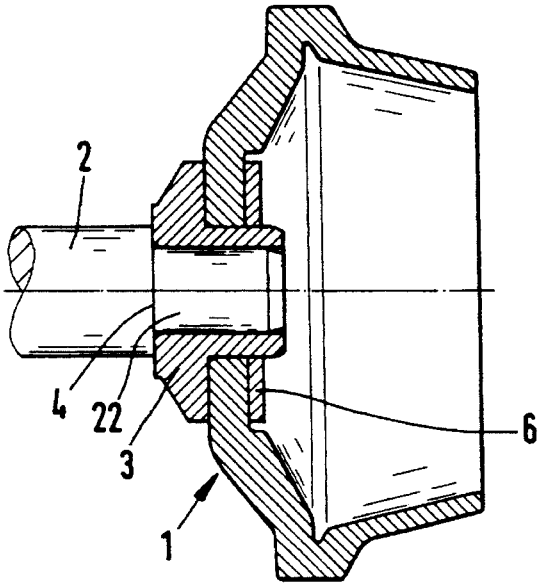
FIG. 4 shows an open-end spinning rotor whose collar is provided with the centering projection, pressed on the spinning rotor.

FIG. 3 shows part of a rotor shaft 2 in which the stop 4 is made in form of a conical diameter change 23 on the rotor shaft 2. A collar 3 is pressed on the rotor shaft 2 and supports the centering piece 7 on which the spinning rotor 1, if it is a thick-walled spinning rotor as shown in the example of FIG. 4, is pressed. The conical diameter change 23 of the rotor shaft 2 can also be small, similarly to what is made possible by the micro-stop 4 with the cylindrical diameter change in FIGS. 1 and 2.

FIG. 4 shows the attachment of a spinning rotor 1 on a rotor shaft 2 where the collar 3 bears upon a stop 4 which is formed by a cylindrical diameter change 22, here a diameter reduction. The conical spring washer 6 bears upon the collar 3 on which the spinning rotor 1 is pressed. It is however also possible for the conical spring washer 6 to bear directly upon the rotor shaft.

Figure 5:
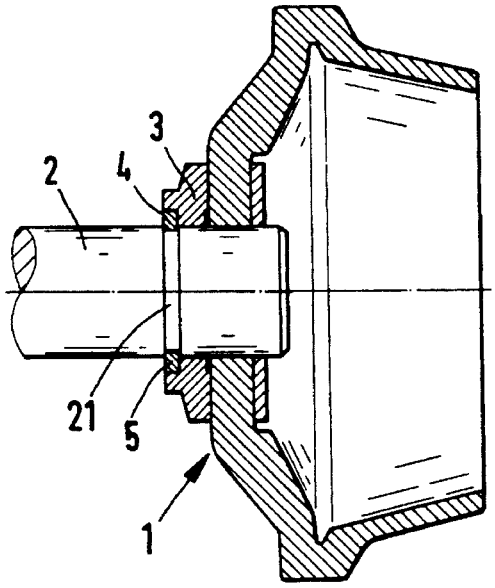
FIG. 5 shows a stop for the collar, made in form of a conical spring washer.

FIG. 5 shows a spinning rotor 1 where the stop 4 is constituted by a snap ring 5 which interacts with a groove 21 of the rotor shaft 2. Due to the fact that the collar 3 reaches over the snap ring 5 the latter cannot expand during operation of the spinning rotor.

Figure 6:
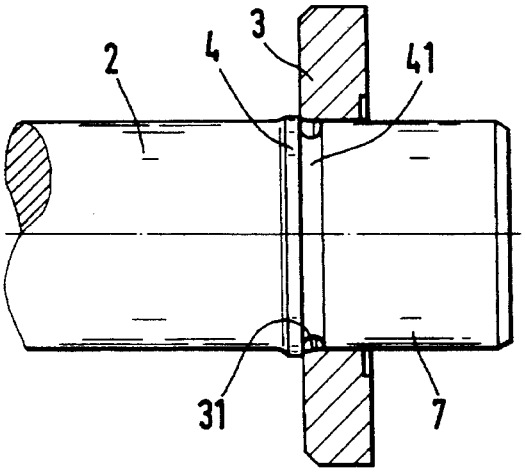
FIG. 6 shows a detail of the stop for the collar.

FIG. 6 shows a detailed view of a rotor shaft 2 of a spinning rotor according to the invention. A collar 3 is pressed on the rotor shaft 2 as shown also in FIG. 1. The stop 4 is made as a micro-stop which was produced on the shaft by grinding the shaft blank to the shaft dimension, with only the area of the stop 4 not being machined. On the side of stop 4 towards the collar 3 the rotor shaft 2 has an undercut 41 so that the collar 3 comes to lie well against stop 4. Advantageously the collar 3 is pressed on the rotor shaft 2 so that not only the stop 4 may absorb forces for the attachment of the spinning rotor. The collar 3 is provided with a slight bevel 31 on the side of its bore towards the stop 4 so that in can be pressed more easily on the rotor shaft 2. The centering piece 7 of the rotor shaft 2 has the same nominal diameter as the rotor shaft 2. The dimensions of the stop 4 are those of FIG. 1 or FIG. 2.

Figure 7:
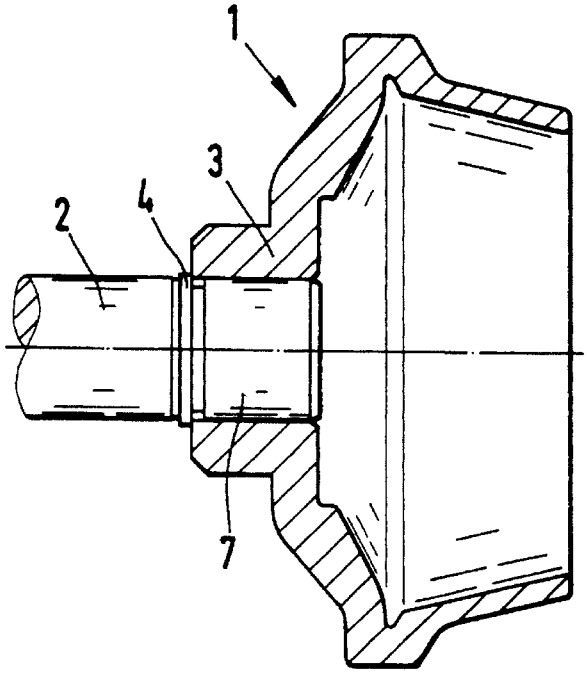
FIG. 7 shows an open-end spinning rotor according to the invention in which the contact surface between the rotor shaft and collar contains solid particles.

FIG. 7 shows a spinning rotor 1 according to the invention on its rotor shaft 2. The spinning rotor is made in one piece with its collar 3. The centering piece 7 is coated with a nickel-diamond layer whereby the connection between the collar 3 and the rotor shaft 2 is improved considerably. A coating in which the hard solid grains are imbedded so that they are at a distance from each other which is equal to approximately five times the diameter of the grains is especially advantageous. When the collar is pressed on the rotor shaft the diamond grains lock into each other in the surface of the of the collar and practically ensure an interlocking connection of the contact surfaces.

Figure 8:
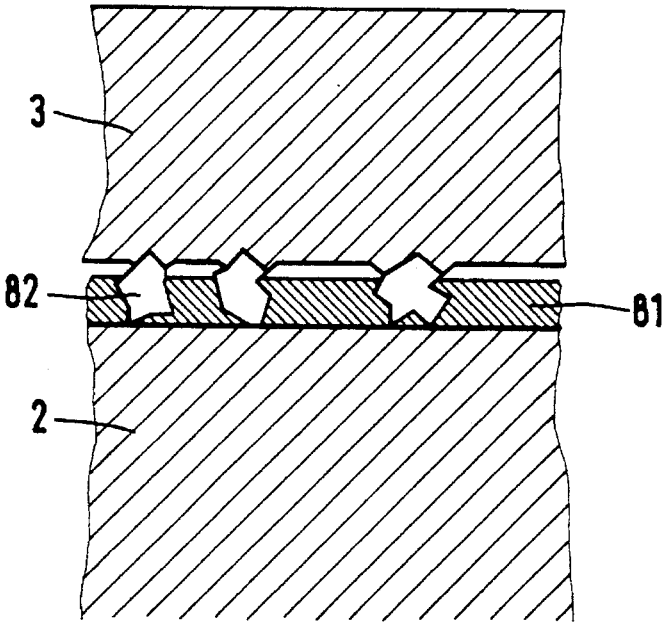
FIG. 8 shows a section of a portion of the contact surface 11 of FIG. 7.

FIG. 8 shows a detailed view of the joint between collar 3 and rotor shaft 2. In the present case the hard solid grains 82 in the form of diamond grains are imbedded in the bonding layer 81 which is made of nickel. The coating is placed on the rotor shaft 2. It is however also possible to coat the collar or the collar as well as the rotor shaft. The rotor shaft 2 of FIG. 7, in addition to the coating according to the invention, is also provided with a stop 4 according to the invention which constitutes a support for the collar 3. If the collar 3 is now pressed on the rotor shaft 2 as shown in FIG. 4, without any additional attachment in the form of a conical spring washer, the utilization of a stop 4 is very advantageous for the strength of the connection, since in particular the axial oscillations can be attenuated by the stop 4. As a result part of the load acting upon the collar 3 through operation of the spinning rotor is absorbed,so that the spinning rotor 1 is securely attached on the rotor shaft 2. In addition to diamond grains as the solid particles and nickel as the bonding layer, other suitable materials an also be used, creating also a kind of additional interlocking connection.

The problem posed can be solved through the embodiment of the rotor shaft according to the invention, with a stop, as well as through the coating of rotor shaft or collar according to the invention. A combination of both is especially advantageous.

It will be apparent to those skilled in the art that various modifications and variations can be made in the present invention without departing from the scope or spirit of the invention. For example, features illustrated or described as part of one embodiment can be used on another embodiment to yield a still further embodiment. Thus, it is intended that the present invention cover such modifications and variations as come within the scope of the appended claims and their equivalents.

We claim:

1. An open-end spinning device, comprising a rotor shaft; a spinning rotor having a back wall and defining an interior, said rotor shaft extending through said back wall into said rotor interior; a collar separate from said spinning rotor disposed about said rotor shaft, said collar defining an axial defining an axial bearing surface against which said spinning rotor back wall frictionally bears longitudinally on said rotor shaft; and a radially extending stop formed on said rotor shaft, said collar axially frictionally bearing in the longitudinal direction upon said stop and disposed between said stop and said spinning rotor; and a retaining device within said rotor interior surrounding said rotor shaft, said retaining device pressing said rotor back wall against said collar axial bearing surface which in turn presses said collar against said stop; said rotor and said collar removable from said rotor shaft by removal of said retaining device without further disassembly of said spinning device for changeout of different sized said rotor and said collars.

2. The device as in claim 1, wherein said stop is formed integral with said rotor shaft.

3. The device as in claim 2, wherein said stop comprises a cylindrical diameter change in said rotor shaft.

4. The device as in claim 2, wherein said stop comprises a conical diameter change in said rotor shaft.

5. The device as in claim 1, wherein said stop is interlockingly connected to said rotor shaft.

6. The device as in claim 5, wherein said stop comprises a groove defined in said rotor shaft and a conical snap ring engagingly fitted into said groove.

7. The device as in claim 1, wherein said stop comprises an axial length of less than 15 millimeters.

8. The device as in claim 7, wherein said axial length of said stop is from 0.1 to 3.0 millimeters.

9. The device as in claim 1, wherein said stop comprises a diameter which is less than twice the diameter of said rotor shaft.

10. The device as in claim 9, wherein said stop projects radially less than 2.0 millimeters beyond said rotor shaft.

11. The device as in claim 1, wherein said retaining device comprising a conical spring washer attached to said rotor shaft, said conical spring washer axially pressing said spinning rotor against said collar.

12. The device as in claim 1, further comprising a centering segment for centering said spinning rotor upon said rotor shaft.

13. The device as in claim 12, wherein said centering segment is formed on said rotor shaft.

14. The device as in claim 12, wherein said centering segment is formed on said collar.

15. The device as in claim 12, wherein said centering segment comprises a diameter essentially equal to the diameter of said rotor shaft.

16. The device as in claim 1, wherein varying size spinning rotors are interchangeable with said spinning rotor, said spinning rotors having a rotor groove defined therein, the axial distance of said rotor groove from the end of said rotor shaft defined by the axial length of said collar wherein thicker walled spinning rotors are used with axially shorter collars, the longitudinal position of the contact point between said stop and said collar remaining the same regardless of the size of said collar or said spinning rotor.

17. An open-end spinning device, comprising a rotor shaft; a spinning rotor having a back wall and defining an interior, said rotor shaft extending through said back wall into said rotor interior; a collar separate from said spinning rotor disposed about said rotor shaft, said collar defining an axial bearing surface against which said spinning rotor back wall frictional bears longitudinally on said rotor shaft; a stop formed on and extending radially from said rotor shaft against which said collar frictionally bears in a longitudinal direction; and raised hard particles embedded between contacting surfaces of said collar and said rotor shaft, said particles tending to interlock and increase frictional between said collar and said shaft; and a retaining device within said rotor interior surrounding said rotor shaft, said retaining device pressing said rotor back wall against said collar axial bearing surface which in turn presses said collar against said stop; said rotor and said collar removable from said rotor shaft by removal of said retaining device without further disassembly of said spinning device for changeout of different sized said rotor and said collars.

18. The device as in claim 17, wherein said particles are also embedded between contacting surfaces of said spinning rotor and said rotor shaft.

19. The device as in claim 18, wherein said particles are embedded in a bonding layer coated on at least one of said rotor shaft, said collar, and said spinning rotor.

20. The device as in claim 17, wherein said particles are embedded in a bonding layer coated on at least one of said rotor shaft and said collar.

21. The device as in claim 17, wherein said bonding layer comprises a layer of essentially nickel.

22. The device as in claim 17, wherein said particles comprise diamonds.

23. The device as in claim 17, wherein said particles comprise silicon carbide.

* * * * *